United States Patent [19]

Bork

[11] Patent Number: 4,965,987

[45] Date of Patent: Oct. 30, 1990

[54] HORSE TACK BIT

[76] Inventor: Gerald R. Bork, 36631 Hathaway, New Baltimore, Mich. 48047

[21] Appl. No.: 253,682

[22] Filed: Oct. 5, 1988

[51] Int. Cl.[5] ..... B68B 1/06

[52] U.S. Cl. ..... 54/7

[58] Field of Search ..... 54/7, 8, 9; 119/134

[56] References Cited

U.S. PATENT DOCUMENTS

| | | | |
|---|---|---|---|
| 52,125 | 1/1866 | Baker . | |
| 424,258 | 3/1890 | Belknap | 54/7 X |
| 479,670 | 7/1892 | Sloat | 54/7 |
| 617,300 | 1/1899 | Schneider . | |
| 660,748 | 10/1900 | Bush | 119/134 X |
| 660,923 | 10/1900 | Purcell | 54/7 |
| 804,700 | 11/1905 | Bethe . | |
| 891,419 | 6/1908 | Herbert . | |
| 907,816 | 12/1908 | Klaus | 54/7 |
| 1,124,108 | 1/1915 | Chenault | 54/7 |
| 1,678,532 | 7/1928 | Preece | 54/7 X |
| 2,488,977 | 11/1949 | Johnson | 54/8 |
| 3,304,692 | 2/1967 | Lovell, Jr. | 54/7 |
| 4,745,733 | 5/1988 | Bork | 54/7 |

*Primary Examiner*—Robert P. Swiatek

*Attorney, Agent, or Firm*—Basile and Hanlon

[57] ABSTRACT

A horse tack bit comprising: a mouth piece having two ends; two opposed tubular cheek pieces, each of said cheek pieces including an angled shank portion which is attached to an end of the mouthpiece and extends rearwardly downwardly and inwardly therefrom and a flexible portion; a bridle ring disposed at the end of each cheek piece proximate the angled portion thereof; a rein connector; flexible cables extending through the tubular cheek pieces and the ends of the mouthpiece and attached at ends thereof to the rein connector and the bridle reins to hold the bit together; and a spring disposed inside of the flexible portion of each cheek piece. In one embodiment, a pair of adjustable connectors are disposed between each bridle rein and each cheek piece. The mouthpiece is provided with threads on each end which threadingly mate with threads formed in each adjustable connector for attaching the mouthpiece to the adjustable connectors. When a set of reins is attached to the rein connector, tensioning the reins in one direction will cause flexion of the bit, thereby turning the head of an animal wearing the bit in the opposite direction of the tension.

9 Claims, 4 Drawing Sheets

HORSE TACK BIT

BACKGROUND OF THE INVENTION

1. Field of the Invention

The invention relates generally to the field of bits usable for controlling the direction of an animal such as a horse, mule or donkey when said animal is being ridden, and more particularly, to a flexible bit which, upon tensioning a set of reins attached thereto on one side of the animal's neck, will flex thereby causing the animal to turn its head in the opposite direction.

2. Description of the Prior Art

The usefulness of horses and other similar animals for the relatively rapid locomotion of a human rider astride the back thereof has been known since approximately 2000 B.C. During this long period of history of horsemanship, various devices have been invented to assist the rider in controlling the animal and causing it to move in the desired direction. The gradual development of more refined control devices has resulted in the now familiar tack arrangement of a bridle comprised of straps which adjustable fit around the animal's head, a metal bit including a mouthpiece adapted to fit in the animal's mouth and extend over and atop its tongue, and a set of reins which are conventionally attached to the bit at either side of the animal's mouth.

In conventional bit design, the ends of the mouthpiece extend out each side of the animal's mouth. The mouthpiece ends are attached to cheek pieces, which provide attachment for the ends of the bridle and the reins. The bit may further comprise extensions of the cheek pieces which extend toward the front of the animal's mouth and, if the reins are attached to the ends thereof, exert a powerful leverage force on the animal's mouth, as with a curb bit. The mouthpiece may comprise a single piece or be jointed in one or more places.

Various bits incorporating some of the features mentioned as well as others are disclosed in U.S. Pat. Nos. 907,816; 804,700; 424,258; 660,923; 479,670; 617,300 and 52,125. In all of these references, and as is conventional in the art, the reins are attached at each side of the animal's mouth either to the cheek pieces or extensions thereof.

Two styles of riding have evolved, both of which have conventionally used bits of the type described above. In English style riding, the set of reins includes a single rein, each end being attached to the bit on each side of the animal's mouth. During riding, one rein is held in each hand on either side of the animal's neck. To direct the animal, one pulls on the right rein to turn the animal right and on the left rein to turn the animal left.

In so-called "Western" style riding, instead of using two hands to hold the reins, only one hand is used. In order to direct the animal, the technique of "neck-reining" is employed. To direct the animal right, for example, the hand holding the reins moves the reins to the right, while slightly lifting them, and lays the left rein on the left side of the animal's neck, thereby causing the neck to turn to the right, and the animal to turn in that direction. While this style of riding has the advantage of leaving one hand free for show contests or other activities, such as roping, etc., it has prior to now been usable only with a properly trained animal. The technique of "neck-reining" causes the animal to turn in the direction opposite the side in which the cue is applied. In other words, if the rein is laid on the left side of the animal's neck, the animal must know to turn right. Such a technique is difficult to use with a combination of a conventional bit and an untrained horse because the animal becomes easily confused since pressure is applied to the opposite side of the mouth than the direction in which the horse is being urged.

Thus, while the technique of neck-reining has the advantage of leaving one hand of the rider free and is mandatory in showing western horses, if it is employed in conjunction with the prior art bits described above, it can only be used with a well trained animal. Thus, the limitations of the prior art do not allow a rider to use a one-handed technique with a relatively untrained or greenbroken animal.

These problems have been addressed in a horse tack bit disclosed in U.S. Pat. No. 4,745,733 issued to Gerald R. Bork, the inventor of the subject matter of the subject invention. The bit disclosed in this patent enables a rider to use a one-handed riding style and causes the animal to turn its head in the same direction as the direction of pull on the reins. It has been found, however, that further improvements could be made to the horse tack bit disclosed in U.S. Pat. No. 4,745,733 in order to simplify its manufacturing and provide adjustability in its size.

SUMMARY OF THE INVENTION

The improved bit design of the present invention overcomes all of the limitations described above. The improved bit of the instant invention comprises: a mouth piece having two ends and an aperture formed in each end extending transverse the longitudinal axis thereof; two opposed tubular cheek pieces, each of said cheek pieces including an angled shank portion attached to an end of the mouth piece to extend downwardly and inwardly therefrom, and a flexible portion; a bridle ring disposed at an end of each cheek piece opposite the flexible portion; spring means disposed inside of the flexible portion of each cheek piece; a rein connector connecting the ends of the cheek pieces adjacent the flexible portions thereof; and a flexible connecting means, the ends of which extend from the rein connector and each of the cheek pieces, and are attached to one of the bridle rings to hold the bit together and permit flexing of the cheek and mouthpiece relative to each other. When a set of reins are attached to the rein connector, the rider may direct the movement of the animal by tensioning the reins, which are held in one hand for showing, in the direction in which it is desired to go. The tension of the reins will cause flexion of the bit in the direction of tension and cause the animal to turn its head in the opposite direction.

For example, if the rider desires the animal to go to the right, he will simply pull the reins in a general rightward direction against the left side of the animal's neck. This rightward pull on the reins will cause the bit to flex, and the right cheek piece of the bit will be pulled generally back and upward. This, in turn, will cause the right side of the mouth piece to be pulled downward and to the right. Since the natural tendency of the animal will be to move its head in the direction in which the mouth piece is exerting pressure on the mouth, the animal will turn its head to the right. This, in turn, will cause the animal to turn in that direction. Since the action of the bit allows the animal to move in the same direction as it would naturally feel a tendency to go, no extensive training is required, either of the rider or animal.

The bit of the present invention may comprise other elements which enhance the flexibility of the bit and also permit adjustment of its size to fit the mouths of various sized animals and/or provides varying amounts of leverage. The bit may further comprise a Y-shaped rein connector, with the flexible connecting means being comprised of two cables. The end of each cable is detachably attached to one end of the arms of the Y-shaped rein connector, the other end of each cable being detachably attached to a bridle ring. The leg of the Y-shaped ring connector may be angled backward to exert a cantilever effect on the bit when a rein attached thereto is pulled. The flexible portion of each cheek piece may comprise an externally disposed spring to allow flexing of the cheek piece and to provide a shock absorbing action.

A pair of adjustable connectors may be provided, each of which has a bore extending through its longitudinal axis, said bore being offset from the center of the longitudinal extent of the connector. In one embodiment, an aperture extends through each adjustable connector in a direction at right angles to that of the bore and also offset from the center line. In this embodiment, each end of the mouth piece has a bore extending therethrough transverse the longitudinal axis of the mouth piece. The ends of the mouth piece may then be slidably inserted through the apertures of the adjustable connectors, with the bores of the mouthpiece aligning with the bores of the adjustable connectors. The two cables may be then passed through the adjustable connectors and the ends of the mouthpiece. When it is desired to adjust the size of the bit, the ends of the adjustable connectors may be detached from the bridle rings by compression of the internal springs of the cheek pieces to permit ready disassembly. By reversing the adjustable connectors end to end, side to side, or both, the size and leverage of the bit may be adjusted either with reference to its length or to its width.

In another embodiment, the two ends of the mouthpiece are threaded. The pair of adjustable connectors are provided with a shaft portion having a bore extending longitudinally therethrough and a tubular leg portion joined to and extending outward from the shaft portion. Threads are formed internally in the tubular leg portions of each adjustable connector and are threadingly connectable to the threaded ends of the mouthpiece.

The mouthpiece may thus be attached to the adjustable connectors by threading its ends into the leg portions of each connector. The length of threading may be varied as the desired to vary the width of the overall bit to enable the bit to be properly sized to a particular animal. Further, the longitudinal bore in the shaft portion of each adjustable connector as well as the leg portion of each adjustable connector can be offset from the longitudinal and lateral centerlines of the connector to provide further adjustablility for the horse tack bit.

BRIEF DESCRIPTION OF THE DRAWING

The various features, advantages and other uses of the present invention will become more apparent by referring to the following detailed description and drawing in which.

DETAILED DESCRIPTION OF THE PREFERRED EMBODIMENTS

Figure 1:
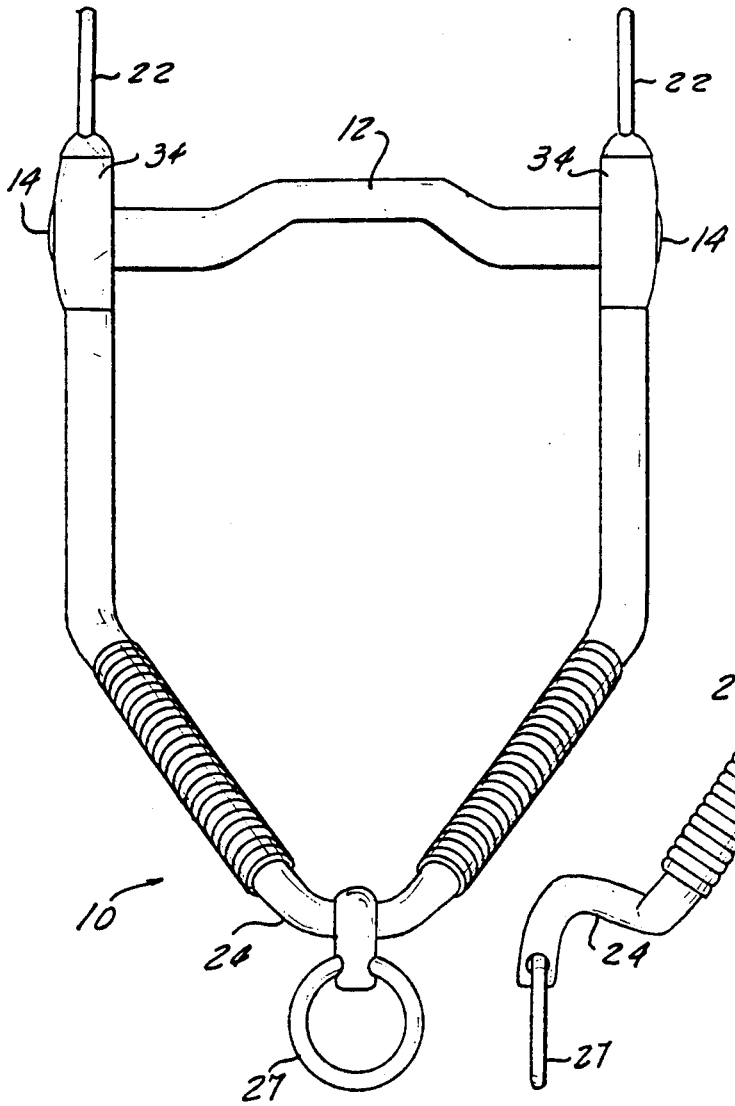
FIG. 1 is an elevational view of a bit constructed in accordance with the instant invention shown in a position mounted on a horse.

Throughout the following description and drawing, identical reference numbers are used to refer to the same component in multiple figures of the drawing.

Figure 2:
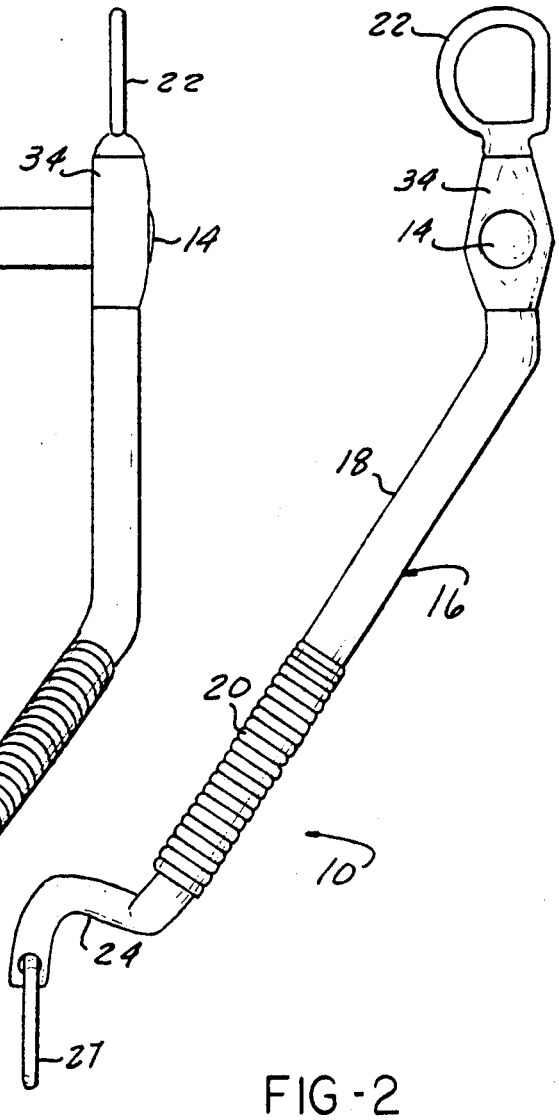
FIG. 2 is a right hand elevational view of the bit of FIG. 1.
Figure 3:
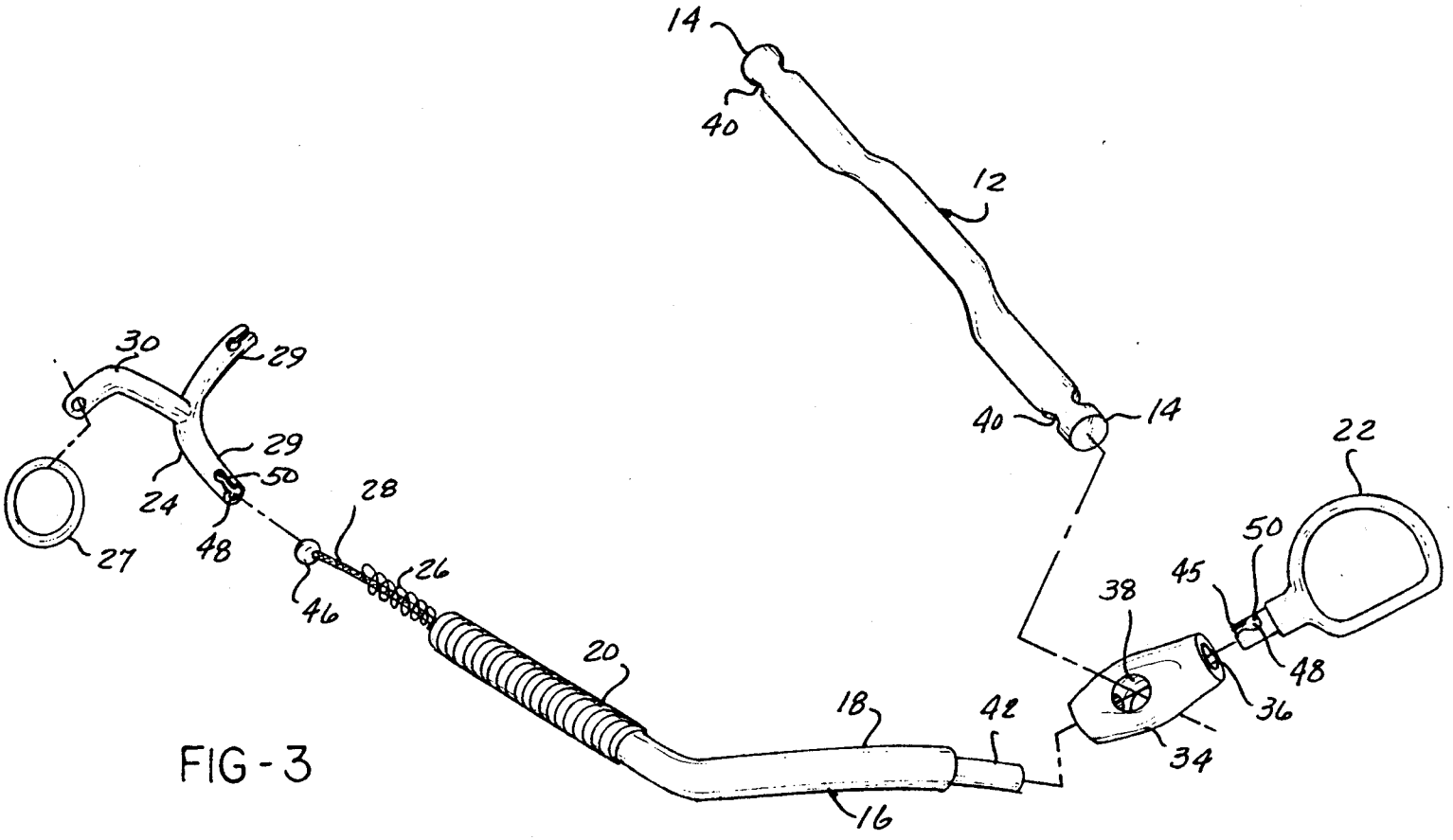
FIG. 3 is an exploded view of the bit of FIG. 1 illustrating the arrangement of the parts thereof.

Referring now to the drawing, and to FIGS. 1, 2 and 3 in particular, there is illustrated a horse tack bit 10. The horse tack bit 10 comprises a mouth piece 12 which has two ends 14. The mouthpiece 12 is shaped in a conventional fashion to fit in the mouth of an animal such as a horse, with a shaped middle portion fitting over the tongue and extending across the mouth of the animal. As may be seen in FIG. 3, each end 14 of the mouth piece 12 has a bore 40 extending therethrough. The purpose of the bores 40 will be explained later.

The horse tack bit 10 further comprises two opposed tubular cheek pieces 16, each of said cheek pieces including an angled shank portion 18 and a flexible portion 20. The opposed tubular cheek pieces 16 are attached to each side of the mouth piece 12 by means of a pair of adjustable connectors 34. The adjustable connectors 34 each have a bore 36 extending therethrough in the direction of the longitudinal axis thereof. The bores 36 are slightly offset from the center line of the adjustable connectors 34. Also extending through each adjustable connector 34 and in a direction transverse that of bore 36 is an aperture 38. Aperture 38 is also offset with respect to the center line of adjustable connector 34.

When an end 14 of mouthpiece 12 is threaded through the aperture 38 located in one of the adjustable connectors 34, the bore 40 adjacent the end 14 of the mouthpiece 12 will come into alignment with the bore 36 formed in the adjustable connector 34. A portion of a reduced diameter 42 formed at the end of each tubular cheek piece 16 adjacent shank 18 may be then inserted into bore 36 near one end of adjustable connector 34, as well as into bore 40.

A pair of bridle rings 22 are also provided. The bridle rings 22 also have formed on one end thereof an area of reduced diameter 45 which may be inserted into bore 36 at the end of adjustable connector 34 opposite the end occupied by the cheek piece 16.

Cheek pieces 16 are shaped such that, when they are fitted into ends 14 of mouth piece 12, the angled shank portions 18 of cheek pieces 16 extend rearwardly, downwardly and inwardly from mouthpiece 12. The shape of cheek pieces 16 is such that, when cheek pieces 16 are attached to mouth piece 12, the assembled bit will fit around the jaw of the animal and extend downward and rearward therefrom, with the flexible portions 20 of cheek pieces 16 extending inwardly toward each other.

Figure 4:
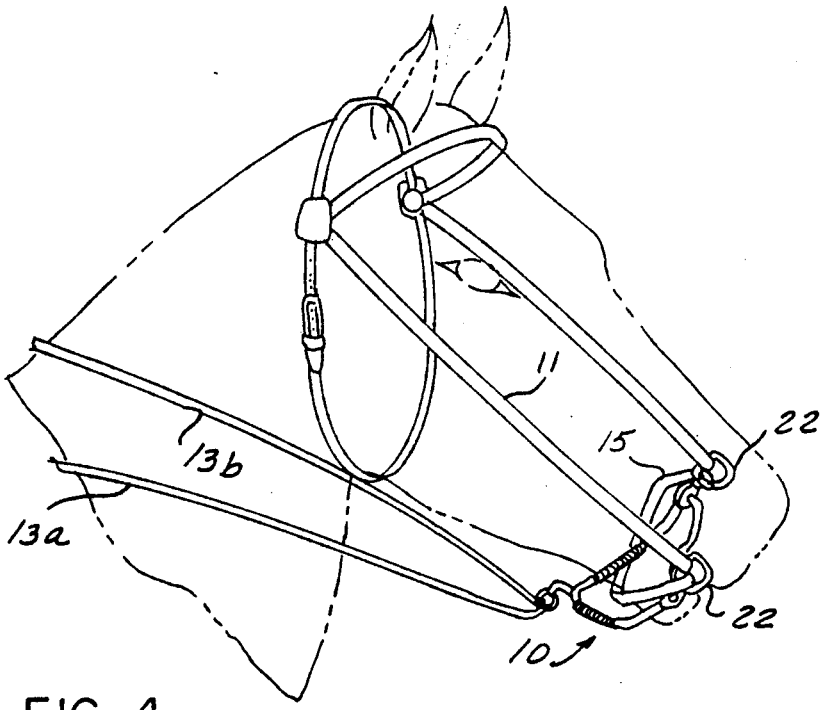
FIG. 4 illustrates the bit of FIG. 1 with a bridle and reins attached thereto and fitted onto the head of a horse.

To connect cheek pieces 16 at the ends adjacent the flexible portions 20, a Y-shaped rein connector 24 is provided. The arms 29 of the rein connector 24 are adapted to be inserted into the ends of the cheek pieces 16 adjacent the flexible portions 20 thereof. The leg portion 30 of Y-shaped rein connector 24 is angled in the manner shown in FIGS. 2 and 3 to provide a cantilever effect on the bit, as will be described further on. Attached to the free end of the leg 30 is a bridle or rein ring 27 adapted for the attachment of a set of reins 13*a* and 13*b* thereto, as is shown in FIG. 4.

Referring in particular to FIG. 3, a pair of flexible cables 28 are provided. FIG. 3 depicts only the right side cable 28 of the bit 10, but it is understood that the bit 10 is symmetrical with respect to the right and left hand sides, and that the right hand structures in FIG. 3 are duplicated on the left hand side of the bit 10. Flexible connecting means or cables 28 serve the purpose of holding the various pieces of bit 10 together. As depicted in FIG. 3, each flexible cable 28 has formed on each end thereof a spherical member 46. Only one such spherical member 46 may be seen in FIG. 3, on the end of flexible connector 28 extending out of one end of cheek piece 16. Since the length of flexible connector 28, when bit 10 is in the disassembled state is shorter than the length of cheek piece 16 the other spherical member 46 formed on the other end of flexible cable 28 does not extend outside of the other end of cheek piece 16. Slots 48 formed on both the ends of the arms 29 of Y-shaped rein connector 24 and the ends of bridle rings 22 are adapted to slidingly receive the ends of the flexibel cable 28 and engage the spherical members 46 formed thereon. Because slots 48 are each formed with a rounded portion 50 adapted to engage spherical member 46, the bit 10 may be assembled by first sliding one end of each flexible cable 28 in a slot 48 until the spherical portion 46 is engaged with a rounded portion 50. The other end of each flexible cable 28 is then passed through tubular cheek piece 16, and bores 40 of mouthpiece 12 and 36 of adjustable connector 34, whereupon the other end is attached to bridle ring 22 by engagement of spherical member 46 with slot 48 and rounded portion 50 described above. Due to the respective lengths of flexible cable 28 and cheek piece 16, the various parts of the bit will remain securely fastened together because flexible cable 28 must be initially compressed to secure both of its ends.

The bit 10 may be easily disassembled and adjustments made in the size thereof in the following manner. The flexible portion 20 which includes an interiorly disposed spring means 26 is compressed to shorten the length of each cheek piece 16. Because of the shortened length of each cheek piece 16, each flexible cable 28 disposed therein will become longer with respect to the cheek piece 16. The spherical members 46 on each end of each flexible cable 28 may be then disengaged from the slots 48 and rounded portions 50 by reversing the steps described above. The length and leverage, for example, of bit 10 may be adjusted by reversing both of the adjustable connectors 34 end to end. Because the bore 38 is off center, the bit 10 will be either longer or shorter relative to the center line of the mouth piece 12 depending upon whether the longer or shorter end of connector 34 is disposed on the end of the cheek piece 16. As shown in FIG. 3, the shorter end of the adjustable connector 34 is shown adjacent the cheek piece 16. If the bit 10 is assembled with the adjustable connector 34 in this orientation, the bit 10 will be shorter along the length of the cheek pieces 16. Similarly the width of the bit 10 may be adjusted because the bore 36 is off center. By disposing the wider side of the adjustable connector 34 next to the mouthpiece 12, a wider bit may be assembled.

Figure 7:
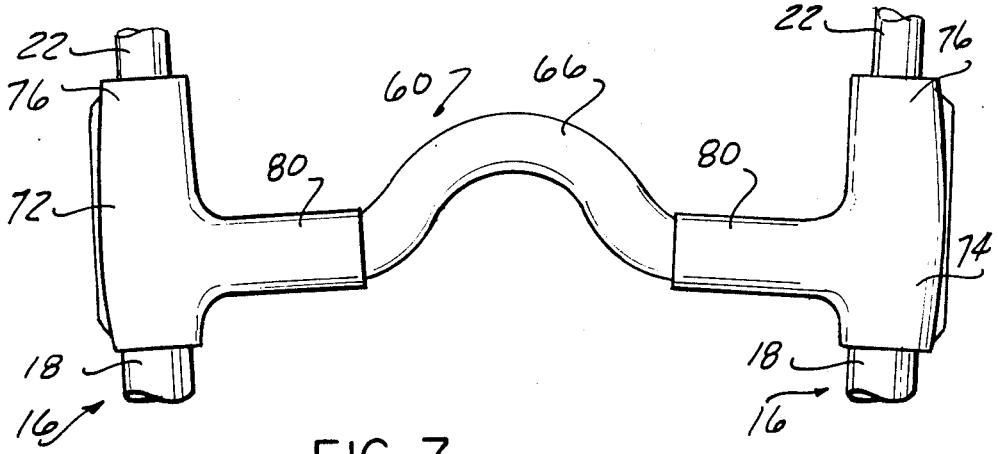
FIG. 7 is a partial, elevational view depicting another embodiment of the mouthpiece and adjustable connectors of the horse tack bit of the present invention.
Figure 8:
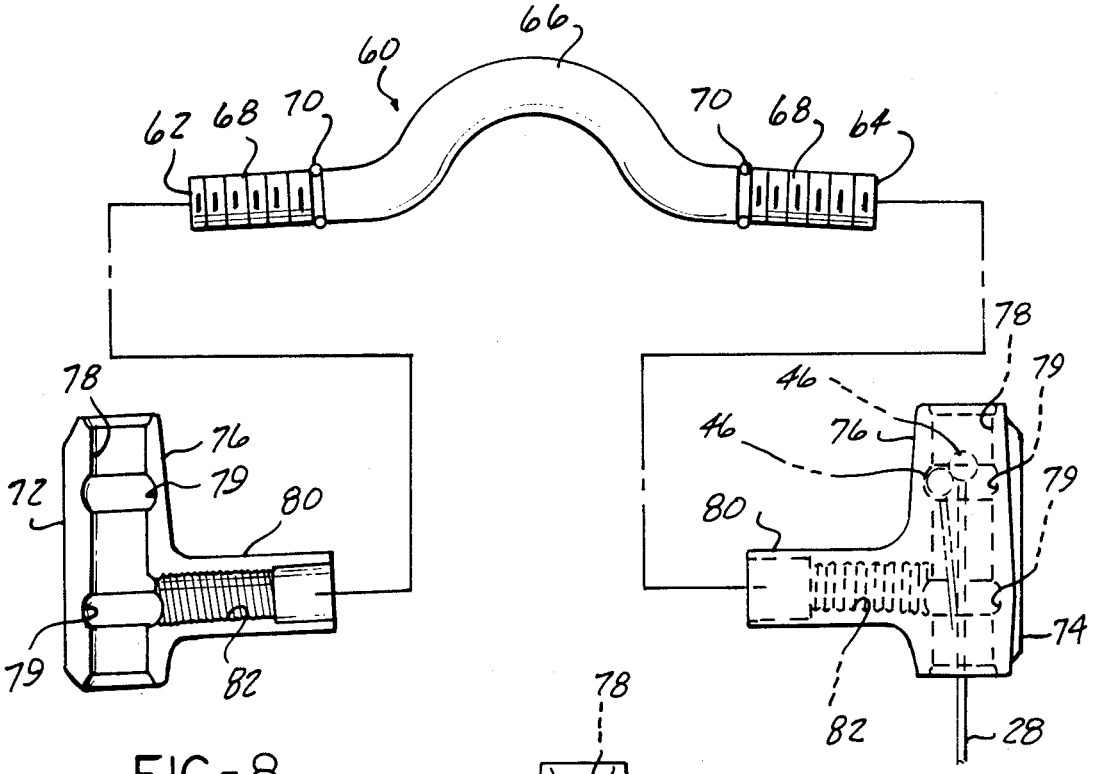
FIG. 8 is an exploded view showing the mouthpiece and adjustable connectors of FIG. 7.
Figure 9:
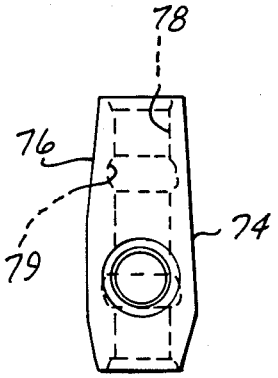
FIG. 9 is an end view of one of the adjustable connectors shown in FIGS. 7 and 8.

Another embodiment of the present invention is illustrated in FIGS. 7, 8, and 9. Depicted therein is another embodiment of the mouthpiece and the adjustable connectors. The remaining portions of the horse tack bit 10 are identical to that described above.

The mouthpiece 60 shown in FIGS. 7 and 8 is formed of a tubular member having first and second ends 62 and 64. A centrally located arcuate or curved section 66 extends integrally between the leg 62 and 64.

A plurality of threads 68 are formed externally on the ends 62 and 64 of the mouthpiece 60 and extend inward a distance from the first and second ends 62 and 64. The pitch of the threads 68 on the first end 62 of the mouthpiece 60 is reversed from that of the threads 68 formed on the second end 64 of the mouthpiece 60. That is, the threads on the first end 62 have a left hand pitch; while the threads on the second end 64 of the mouthpiece 60 have a right hand pitch.

A recess is formed adjacent the innermost end of the threads 68 and receives a seal means 70, such as a O-ring, for sealing the threads 68 from debris when the mouthpiece 60 is attached to the adjustable connectors.

The horse tack bit shown in FIGS. 7, 8 and 9 also includes a pair of adjustable connectors 72 and 74. Each adjustable connector 72 and 74 has an elongated shaft portion 76 through which extends a longitudinal bore 78. The bore 78 receives the cable 28 therethrough as described above and illustrated in FIGS. 3 and 9.

The bore 78 in each adjustable connector 72 and 74 has a pair of spaced undercuts 79. The undercuts 79 have an enlarged diameter, annular form. The undercuts 79 serve as a lock to retain the cable 28 and attached bridle rings 22 on the bit 10.

FIG. 8 depicts the position of the spherical portion or ball 46 on the end of the cable 28 when the bridle ring 22, not shown, is connected to the connector 72 or 74. When the compression force on the spring 26 in the cheek piece 18 is removed, the spring force exerted by the spring 26 urges the spherical portion or ball 46 of the cable 28 into the lower portion of the round portion 50 of the slot 48 in the bridle ring 22 and radially outward in the bore 78 as shown in phantom in FIG. 9 until the spherical portion 46 engages the undercut 79 in the bore 78 to lockingly connect the bridle ring 22 to the connector 72 or 74. At the same time, the bridle ring 22 is free to rotate about the connector 72 or 74.

During assembly or disassembly of the bit 10, compressive force applied to the spring 26 will enable the ball 46 to move from the undercut 79 to the center of the bore 78 for attachment to or removal from the bridle ring 22.

Further, each adjustable connector 72 and 74 has a leg portion 80 integrally formed with an extending outward from the shaft portion 76. The tubular leg portion 80 on each adjustable connector 72 and 74 is optionally offset from the longitudinal center of each adjustable connector as is the bore 38 described above. Likewise, the bore 78 extending longitudinally through each adjustable connector 72 and 74 may also be optionally offset from longitudinal center of each connector in the same manner as longitudinal bore 36 described above.

A plurality of internal threads 82 are formed in the leg portion 80 of each adjustable connector 72 and 74.

The threads 82 threadingly mate with the threads 68 formed on the first and second ends 62 and 64 of the mouthpiece 60 to connect the mouthpiece 60 to the adjustable connectors 72 and 74. As with the mouthpiece 60, the threads 82 on the adjustable connector 72 are formed with a left hand pitch; while the threads 82 in the adjustable connector 74 are formed with a right hand pitch to threadingly mate with the corresponding threads 68 on the first and second ends 62 and 64 of the mouthpiece 60. This enables the width of the horse tack bit to be adjusted by merely rotating the mouthpiece 60 with respect to the adjustable connectors 72 and 74 to thereby change the amount of threading connection between the ends of the mouthpiece 60 and the adjustable connector 72 and 74. Thus, more or less of the mouthpiece 60 may be moved into threading engagement with the adjustable connectors 72 and 74 to vary the spacing between the cheek pieces 16 of the horse tack bit. Such adjustments may also be performed without disassembling the entire horse tack bit thereby enabling the horse tack bit of the present invention to be easily adapted in size to different sized animals in a quick and simple manner.

While the attachment of the mouthpiece 60 to the adjustable connector 72 and 74 is different from that illustrated in FIGS. 1, 2, and 3, the overall horse tack bit functions in the same manner described below.

The operation of the bit 10 while in use for horseback riding will now be described. In FIG. 4, a bridle 11 is shown attached to the bridle rings 22. A curb strap 15 is connected between the rings 22. Reins 13*a* and 13*b* are shown attached to the rein ring 27 of bit 10. The bridle and bit are shown in place on a horse's head, with reins 13*a* and 13*b* extending on either side of the animal's neck. It may be understood that the bridle depicted is only chosen by way of example, and any other bridle design, of which there are many, may be selected with equally good results. The ends of the reins 13*a* and 13*b* are shown separately. It is to be understood that they could also be attached to each other to form a single rein.

Figure 6:
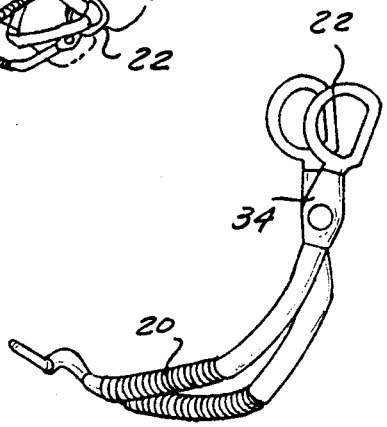
FIGS. 5 and 6 illustrates the flexion of the bit of FIG. 1 when it is under tension from a left side pull of one of the reins.
Figure 5:
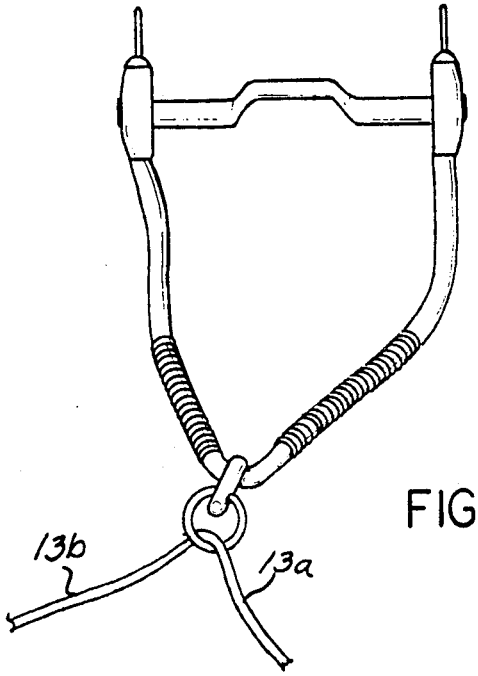

As is shown in FIGS. 5 and 6, when one of the reins 13*a* or 13*b* is pulled to one side of the animal's neck, in this case to the left side, the bit 10 will be flexed in the manner shown. The bit 10 will be flexed to the left, and the angled shank portion of the right side cheek piece 16 will be forced forward. This in turn will cause the left side cheek piece 16 to pivot backward. Because the horse's mouth is subjected to pressure to the right, the horse will turn its head to the right. This rightward turning of the head will cause the entire animal to turn in the rightward direction. Although not depicted, pressure on the right hand side will cause similar flexion of the bit to the right, side will cause similar flexion of the bit to the right, causing the cheek piece 16 to move to the left. This will cause the horse to then turn left.

It has been found that using the improved bit of the instant invention with a greenbroken or relatively untrained horse will permit easy, one-handed control of the animal. As mentioned above, this has heretofore not been possible. The bit of the instant invention takes advantage of the natural tendency of the animal to turn its head in the same direction in which pressure is exerted. The horse does not have to learn that pressure on the left side of the neck when "neck-reining" really means for the horse to turn to the right. Thus, the action of the bit of the instant invention is more natural and causes less confusion to both animal and rider.

The inventor has also used the improved bit design with well trained and experienced animals who have previously been trained to neck rein. Even though the action of the bit is completely opposite from that of conventional bits, it has been found that the lag time for the well trained horse to re-learn the operation of the new bit has been virtually nil. Even horses used to the older methods have readily adapted to the method of using the improved bit of the instant invention.

In summary, there has been disclosed and described an improved design for a horse tack bit. The improved design capitalizes on the natural tendency of the horse to turn its head in the direction in which its mouth feels pressure. In order to accomplish this, the bit of the instant invention is made to flex in the opposite direction from which the neck pressure is applied. Instead of having cheek pieces disposed on either side of the mouth and unconnected to each other, the cheek pieces of the instant bit are connected by a rein connector. The bit may be also easily disassembled for cleaning and quick adjustments in its length and width readily made.

It has also been found that certain elements of the bit described above and specifically shown in FIG. 8 may advantageously be employed as a so-called "English" bit. Such bits generally comprise a mouthpiece with connectors at each opposed end which receive a separate rein held by the rider in a two-handed grip to direct the horse either left or right depending upon which rein is pulled. This type of bit does not use the cantilever action of the bit 10 described above.

In constructing an "English" bit from the components of the bit described above, a mouthpiece 60 may be employed with threaded opposed ends 62 and 64 as shown in FIG. 8. Adjustable connectors 72 and 74 each having a threaded bore formed in a leg portion 80 threadingly receive the threaded ends 62 and 64 of the mouthpiece 60. Each adjustable connector 72 and 74 may be provided with a longitudinal bore 78 extending substantially perpendicular to the leg 80 as described above. A C-shaped, open-ended ring, not shown, is attached at its ends to opposed ends of each adjustable connector 72 and 74. The attachment of the C-ring to each adjustable connector 72 and 74 may be had in any suitable manner, such as a solid, fixed connection or by means of a removable fastener. In employing a removable fastener, a pin, for example, may be disposed through the opposed ends of the C-shaped ring and the longitudinal bore 78 in the adjustable connector 72 and 74 and fixed in position to securely attach the C-shaped ring to each adjustable connector 72 and 74. The attached C-shaped rings and adjustable connector 72 and 74 form a so-called "English" bit which enables two-handed control of a horse via selective movement of either of the two reins attached to each of the C-shaped rings and adjustable connectors 72 and 74.

The "English" bit constructed of the adjustable mouthpiece 60 and adjustable connector 72 and 74 provides the advantages of an adjustable width "English" bit and at the same time enables a variety of different shaped mouthpieces 60, such as mouthpieces having varying accurately shaped central portions, to be employed with the adjustable connectors without the necessity of contrasting a separate complete bit for each different mouthpiece.

What is claimed is:

1. A horse tack bit comprising:

a mouthpiece having two ends;

two adjustable connectors, each having a shaft portion with a bore extending through the longitudinal axis thereof and a tubular leg portion joined to and extending outward from the shaft portion;

thread means, formed on the leg portion of each adjustable connector and on each end of the mouthpiece, for threadingly attaching the mouthpiece to the adjustable connectors;

the thread means in one of the leg portions of the adjustable connectors and the ends of the mouthpiece being oppositely threaded from each other such that rotation of the mouthpiece when connected to the adjustable connectors causes a change in the distance that the mouthpiece is threaded into the adjustable connectors and the distance between the adjustable connectors;

two opposed tubular cheekpieces, each of said cheek pieces including an angled shank portion disposed adjacent to an adjustable connector and extending rearwardly and downwardly and inwardly from the mouthpiece and a flexible portion;

a bridle ring disposed at the end of each adjustable connector opposite the end disposed adjacent to the cheek piece;

a connector disposed at the end of each cheek piece approximate the flexible portions thereof and having opposed arms and a central leg angularly disposed with respect to the arms;

flexible connecting means extending through the cheek pieces and the adjustable connectors for connecting the bridle rings to the arms of the connector; and wherein when a set of reins is attached to the connector, tensioning the reins in one direction indicating a turn in a direction opposite from the direction of tension will cause the connector to exert a cantilever action on the cheek piece and associated bridle ring opposite from the direction of tension with respect to the other cheek piece causing pressure to be applied to the animal's head opposite from the direction of tension, thereby turning the animal's head in the opposite direction of the tension.

2. The bit of claim 1 wherein the bore extending through the shaft portion of each adjustable connector is offset from the longitudinal center of each adjustable connector.

3. The bit of claim 1 wherein:

the tubular leg portion of each adjustable connector is offset from the center of the shaft portion of each adjustable connector.

4. The bit of claim 1 wherein:

the thread means are formed externally on the ends of the mouthpiece and the thread means are formed internally in the leg portion of each adjustable connector.

5. The bit of claim 1 further including:

seal means mounted on the mouthpiece adjacent each end for sealingly covering the thread means formed on the mouthpiece after the mouthpiece has been threadingly connected to the pair of adjustable connectors.

6. The bit of claim 1 further including:

means for locking the flexible connecting means and the bridle ring to each adjustable connector.

7. The bit of claim 6 further comprising:

biasing means, disposed internally within the flexible portion of the cheekpieces, for biasing the bit to its normal position and allowing its movement for assembly and disassembly;

the locking means comprising:

an annular recess formed in the bore of each adjustable connector; and the flexible connecting means having an enlarged end portion engageable with the bridle ring, the enlarged end portion engaging the annular recess in the bore of the adjustable connector to lock the bridle ring to the adjustable connector when the biasing means biases the bit to its normal position.

8. A horse tack bit comprising:

a mouthpiece having two ends;

two adjustable connectors, each having a shaft portion with a bore extending through the longitudinal axis thereof and a tubular leg portion joined to and extending outward from the shaft portion;

thread means formed externally on the ends of the mouthpiece;

thread means formed internally on the leg portion of each adjustable connector for threadingly attaching the mouthpiece to the adjustable connectors;

seal means mounted on the mouthpiece adjacent each end for sealingly covering the thread means formed on the mouthpiece after the mouthpiece has been threadingly connected to the pair of adjustable connectors;

two opposed tubula cheek pieces, each of said cheek pieces including an angle shank portion disposed adjacent to an adjustable connector and extending rearwardly an downwardly and inwardly from the mouthpiece and a flexible portion;

a bridle ring disposed at the end of each adjustable connector opposite the end disposed adjacent to the cheek piece;

a connector disposed at the end of each cheek piece approximate the flexible portions thereof and having opposed arms and a central leg angularly disposed with respect to the arms;

a flexible connecting means extending through the cheek pieces and the adjustable connectors for connecting the bridle rings to the arms of the connector; and wherein when a set of reins is attached to the connector, tensioning the reins in one direction indicating a turn in a direction opposite from the direction of tension will cause the connector to exert a cantilever action on the cheek piece and associated bridle ring opposite from the direction of tension with respect to the other cheek piece causing pressure to be applied to the animal's head opposite from the direction of tension, thereby turning the animal's head in the opposite direction of the tension.

9. A horse tack bit comprising:

a mouthpiece having two ends;

two adjustable connectors, each having a shaft portion with a bore extending through the longitudinal axis thereof and a tubular leg portion joined to and extending outward from the shaft portion;

thread means, formed on the leg portion of each adjustable connector and on each end of the mouthpiece, for threadingly attaching the mouthpiece to the adjustable connectors;

two opposed tubular cheekpieces, each of said cheek pieces including an angled shank portion disposed adjacent to an adjustable connector and extending rearwardly and downwardly and inwardly from the mouthpiece and a flexible portion;

a bridle ring disposed at the end of each adjustable connector opposite the end disposed adjacent to the cheek piece;

a connector disposed at the end of each cheek piece approximate the flexible portions thereof and having opposed arms and a central leg angularly disposed with respect to the arms;

a flexible connecting means extending through the cheek pieces and the adjustable connectors for connecting the bridle rings to the arms of the connector;

biasing means, disposed internally within the flexible portion of the cheekpieces, for biasing the bit to its normal position and allowing its movement for assembly and disassembly;

means for locking the flexible connecting means and the bridle ring to each adjustable connector; the locking means comprising:

an annular recess formed in the bore of each adjustable connector; and the flexible connecting means having an enlarged end portion engageable with the bridle ring, the enlarged end portion engaging the annular recess in the bore of the adjustable connector to lock the bridle ring to the adjustable connector when the biasing means biases the bit to its normal position; and wherein when a set of reins is attached to the connector, tensioning the reins in one direction indicating a turn in a direction opposite from the direction of tension will cause the connector to exert a cantilever action on the cheek piece and associated bridle ring opposite from the direction of tension with respect to the other cheek piece causing pressure to be applied to the animal's head opposite from the direction of tension, thereby turning the animal's head in the opposite direction of the tension.

* * * * *